US008186952B2

(12) United States Patent
Tibbott

(10) Patent No.: US 8,186,952 B2
(45) Date of Patent: May 29, 2012

(54) BLADE ARRANGEMENT

(75) Inventor: Ian Tibbott, Lichfield (GB)

(73) Assignee: Rolls-Royce PLC, London (GB)

( * ) Notice: Subject to any disclaimer, the term of this patent is extended or adjusted under 35 U.S.C. 154(b) by 608 days.

(21) Appl. No.: 12/386,000

(22) Filed: Apr. 27, 2009

(65) Prior Publication Data

US 2009/0280011 A1 Nov. 12, 2009

(30) Foreign Application Priority Data

May 7, 2008 (GB) ..... 0808206.7

(51) Int. Cl.
*F01D 5/18* (2006.01)

(52) U.S. Cl. ..... 416/95; 416/193 R; 416/223 A; 416/97 A; 416/97 R; 415/115

(58) Field of Classification Search ..... 415/115; 416/95, 193, 223 A, 97 A, 97 R
See application file for complete search history.

(56) References Cited

U.S. PATENT DOCUMENTS

| | | | |
|---|---|---|---|
| 6,884,029 | B2 | 4/2005 | Beeck |
| 2004/0081548 | A1 | 4/2004 | Zess et al. |

FOREIGN PATENT DOCUMENTS

| | | | |
|---|---|---|---|
| CA | 2 601 934 | A1 | 3/2008 |
| EP | 1 074 697 | A2 | 2/2001 |
| JP | A-2006-002609 | | 1/2006 |
| WO | WO 03/052240 | A2 | 6/2003 |

*Primary Examiner* — Junghwa M Im
(74) *Attorney, Agent, or Firm* — Oliff & Berridge, PLC

(57) ABSTRACT

With regard to gas turbine engines it will be appreciated that blades are typically cooled in order to ensure that the materials from which the blades are formed remain within acceptable operational parameters. Coolant is judiciously used in order to maintain engine operational efficiency. Unfortunately with regard to rotor blades horseshoe vortices tend to increase heating towards a pressure side of a blade resulting in localized overheating. Such localized overheating may result in premature failure of the blade component. Traditionally coolant flows have been presented over a forward projection of a blade platform. In such circumstances coolant flow will not be used as efficiently as possible with regard to protecting a pressure side of a platform in a blade assembly and arrangement. By provision of a deflector element on the forward blade platform coolant flow can be proportioned either side of a leading edge of the blade. In such circumstances generally asymmetric coolant flow is provided normally biased towards the pressure side in order to enhance cooling efficiency. A suction side in an adjacent blade assembly is cooled by spent coolant and hot gas flow from the pressure side of a neighboring blade upstream in the assembly.

15 Claims, 7 Drawing Sheets

BLADE ARRANGEMENT

A patent invention relates to blade arrangements and more particularly to blade arrangements utilised in gas turbine engines in order to facilitate cooling of the blades.

Within a gas turbine engine it will be appreciated that the performance of the gas turbine engine cycle, whether made in terms of efficiency or specific output, is improved by increasing the turbine gas temperature. In such circumstances it is desirable to operate the turbine at as high a gas temperature as possible. For any engine cycle, in terms of compression ratio or bypass ratio, increasing the turbine entry gas temperature will always produce more specific thrust. Unfortunately, as turbine engine temperature increase it will be understood that the life of an uncooled turbine blade falls necessitating the development of better materials and/or internal cooling of the blades.

Modern gas turbine engines operate at turbine gas temperatures which are significantly hotter than the melting point of the blade material used. Thus, at least high pressure turbines as well as possibly intermediate pressure turbines and low pressure turbines are cooled. During passage through the turbine it will be understood that the temperature of the gas decreases as power is extracted. In such circumstances the need to cool static or rotating parts of the engine decrease as the gas moves from the high temperature stages to the low temperature stages through to the exit nozzle for the engine.

Typical forms of cooling include internal convection and external films. A high pressure turbine nozzle guide vane (NGV) consumes the greatest amount of cooling air. High pressure turbine blades typically use approximately half of the coolant that is required for nozzle guide vanes. Intermediate and low pressure stages down stream of the high pressure turbine progressively utilise and need less cooling air.

The coolant used is high pressure air taken from the compressor. The coolant bypasses the combustor and is therefore relatively cool compared to the gas temperature of the working fluid. The coolant temperature often will be 700 to 1000 k whilst working gas temperatures will be in the excess of 2000 k.

By taking cooling air from the compressor it will be understood that the extracted compressed air can not be utilised to produce work at the turbine. Extracting coolant flow from the compressor has an adverse effect upon engine overall operating efficiency. In such circumstances it is essential that coolant air is used most effectively.

FIG. 1 provides a pictorial illustration of a typical prior blade arrangement including a nozzle guide vane (NGV) and a rotor blade 2. A nozzle guide vane 1 comprises an outer platform 3, an inner platform 4 and an aerofoil vane 5 between. A rotor blade 2 comprises a shroud 6, a platform 7 with an aerofoil blade 8 between them. The guide vane 1 is substantially static and fixed whilst the rotor blade 2 rotates upon a rotor disc 9 secured through a blade root 10. Generally, a seal shroud 11 is provided in association with a support casing 12 in order to define a path across the arrangement 13 in the direction of arrowheads A. The vanes 1 and rotor blades 2 will generally be in assembly as indicated with the vanes stable and static whilst the rotor blades 2 rotate in the direction of arrowheads B to generate flow.

In such circumstances generally coolant for respective vanes and blades 5, 8 is through a combination of dedicated cooling air and secondary leakage flow especially from aerofoil components such as platforms and shrouds. Nozzle guide vane platforms 3, 4 and blade platforms 7 generally use leakage flow to cool an upstream region. Dedicated coolant flow is used to cool down regions of the platforms 3, 4, 7.

In the case of blades the leakage flow used to cool the upstream regions of the inner platform 4, 7 is called platform root seal leakage flow. Such coolant flow is bled up the front surface of the turbine disk 9 and is used to purge the cavity created between the rear of a nozzle guide vane inner platform 4 and the forward extension of the platform 7. In such circumstances together the inner platform 4 and the forward extension of the blade platform 7 form an over lapping seal arrangement.

Generally the purge flow is in the region of 1-2 percent of the mainstream flow and covers the blade platform 4 and forward extension in a stream of cool air. This cool air forms a film over the blade platform 2 and cools the hot gas wash surface of that platform 7. It will be understood that this coolant flow is a relatively dense leakage that travels around the aerofoil leading edge 14 and onto a suction surface of the platform 7. After the platform suction surface the relatively dense coolant air migrates up the aerofoil suction surface around a mid chord location of the blade 8. Unfortunately, the platform 7 forward pressure surface is left exposed to hot gas in the direction of arrowhead A over the vanes and blades 5, 8 as well as platforms 3, 4, 7. It will also be appreciated in addition, the aerofoil leading edge 14 and platform geometry causes the hot gas to migrate from a location close to the mid span of the blade 8 where the inlet gas temperature, due to the combustor radial profile is higher. Such migration of the hot midstream gas upstream of the aerofoil leading edge is called the "horse shoe vortex" secondary flow phenomenon. This secondary flow phenomenon is characteristic in the region where the aerofoil leading edge and platform meet to form a fillet radius. The horse shoe vortices are very powerful and cannot be easily destroyed by appropriate configuration of the arrangement 13. In such circumstances hot gas is entrained by the horse shoe vortices resulting in localised over heating. Such localised over heating causes thermal gradients which precipitate cracking and oxidisation prematurely within the platform.

FIG. 2 provides an isometric schematic view of a typical high pressure turbine rotor blade 18. A front blade platform seal leakage flow 20 is shown travelling radially up a front face of a blade attachment root 19 over a front platform 21 which provides an over hang. The leakage flow 20 then passes around an aerofoil leading edge 24 and onto a suction surface 22. Hot combustion gas 23 is entrained by a horse shoe vortex 25 and therefore travels along and in contact with a pressure surface 26. In such circumstances respective hot gas 23 and coolant flow 20 present leakage paths which result in an arrangement 27 which presents high thermal gradients characterised by differences between a hot pressure surface 26 and a relatively cool suction surface 22 and ultimately leading to potential premature component failure due to thermal cycle cracking and oxidation attack.

In the above circumstance a relatively large quantity of coolant leakage flow is utilised for acceptable aerofoil leading edge and platform suction surface cooling. Hot gas is entrained by horse shoe vortices 25 and entrainment to a pressure surface 26 causes overheating locally. The difference in the temperature for the pressure surface 26 and the suction surface 22 causes high thermal gradients inducing stressing and oxidation problems and therefore premature component failure. Generally spent leakage flow 20 migrates up the suction surface of the air flow 18 causing significant mixing and reduction in turbine efficiency.

It will be noted that the coolant flow 20 is presented at an inlet angle 28 and this angle in association with the forward platform extension 21 controls presentation of the coolant flow 20. The angle 28 is generally determined by the turbine stage aerodynamics and to a lesser extent the platform 21 dimensions.

In accordance with aspects of the present invention there is provided gas turbine engine comprising a rotor assembly having a rotational axis, the assembly comprising a first component and a rotor arranged about the axis, the rotor comprising an annular array of radially extending blades each having a pressure surface, a suction surface, a blade root and a platform that extends forwardly from the blade root and overlaps the first component to define a gap therebetween, the assembly is characterised in that the platform comprises a deflector extending from the platform towards the first component across the gap such that at least a portion of a fluid passing through the gap is deflected towards the pressure surface.

Preferably, the deflector is elongate with a first end and a second end, the second end is circumferentially rearward, with respect to the direction of rotation, of the first end.

Preferably, the blade comprises a leading edge; the deflector is positioned on the platform wherein its first end is positioned at an angle θ between 20° and 60° from a line parallel to the rotational axis and that meets the leading edge. A known preferred angle θ=40°.

Generally, a working gas impinges on the rotating blade at an angle α relative to the axis; the blade comprises a leading edge and the deflector is positioned on the platform wherein its first end is positioned to intersect a line at an angle θ=α from a line parallel to the rotational axis each line meeting at the leading edge.

Preferably, the deflector extends in a circumferential direction between 25% and 75% of the circumferential length of the platform of each blade. A known preferred deflector extends in a circumferential direction 50% of the circumferential length of the platform of each blade.

Preferably, the deflector is straight and extends generally in a circumferential direction.

Alternatively, the deflector is arcuate or at least a part of the deflector is angled with respect to the circumferential direction. Optionally, the deflector is segmented.

Preferably the first component defines a trough adjacent the deflector.

Optionally, the deflector and/or trough comprise at least one rib that extends radially outwardly. The rib(s) is angled from a radial line.

The first component may be rotating and possibly counter-rotating.

Embodiments in aspects to the present invention will now be described by way of example with reference to the accompanying drawings in which:—

Figure 6B:
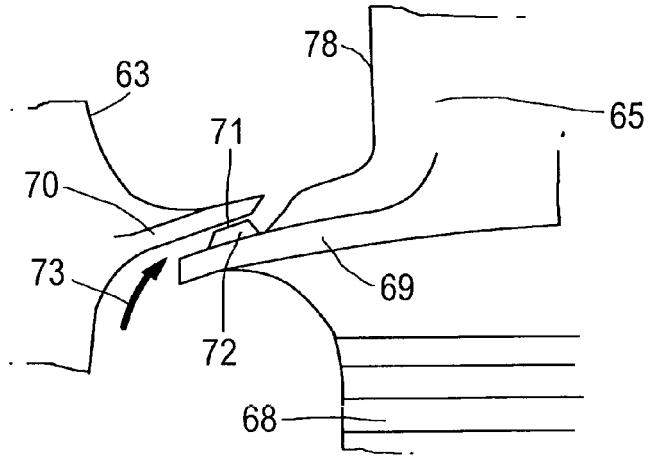
Figure 6A:
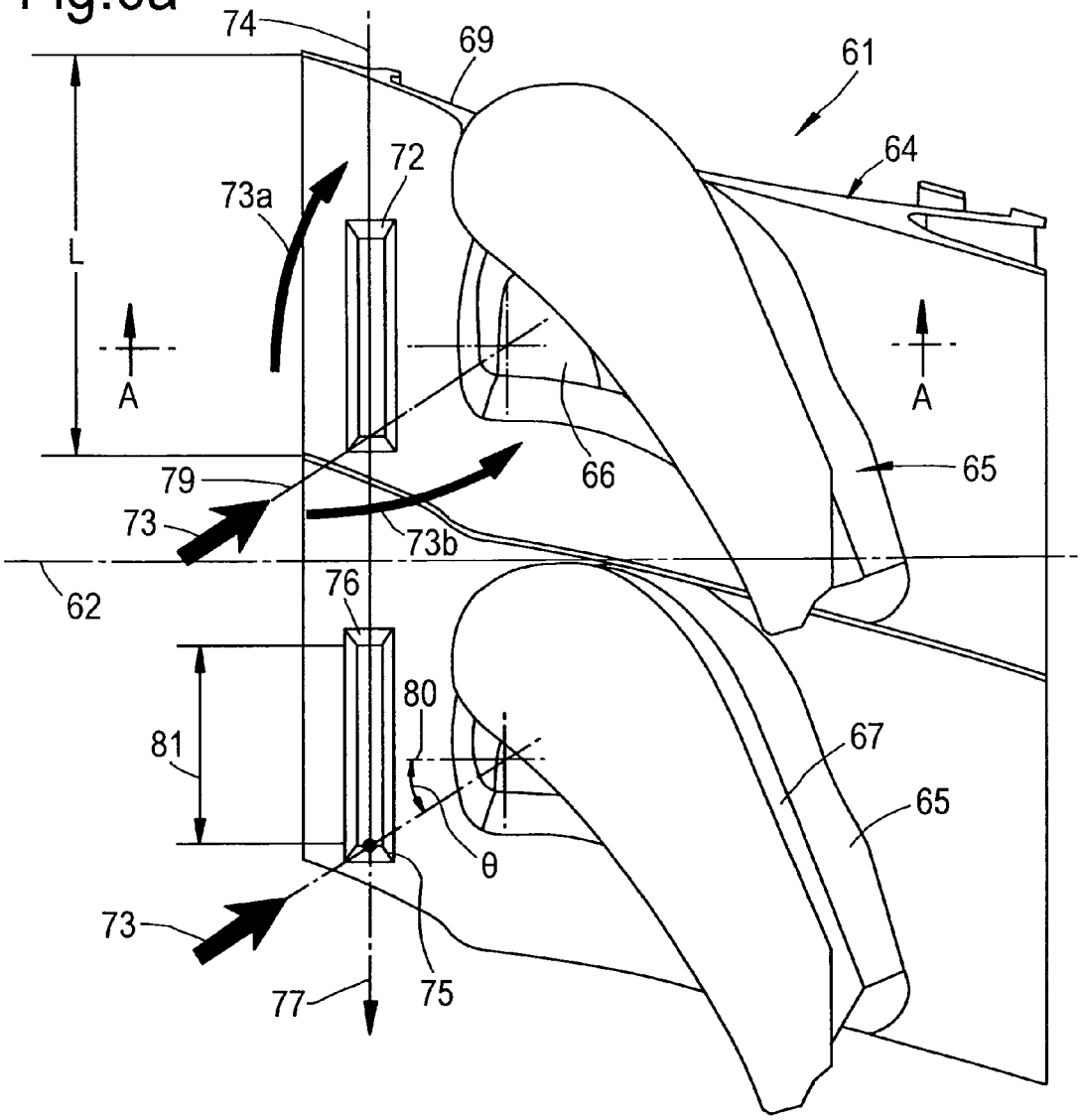
Figure 7A:
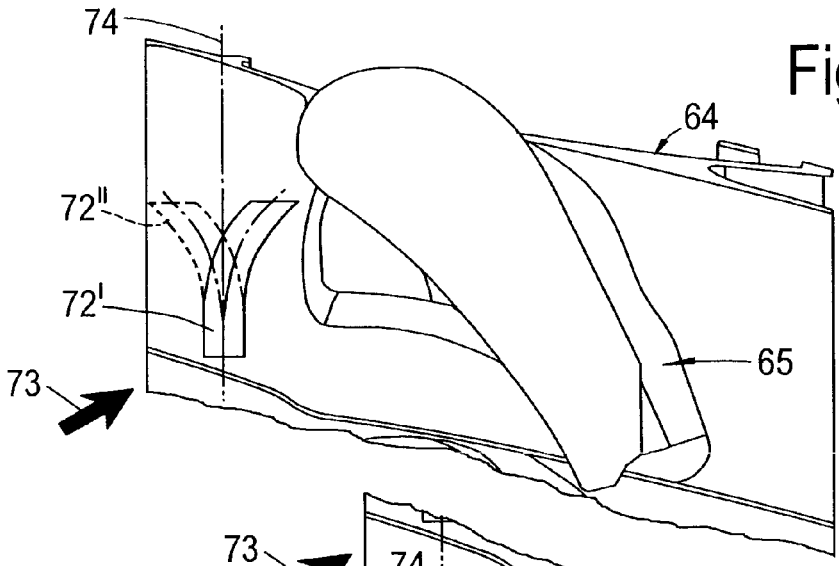
Figure 7B:
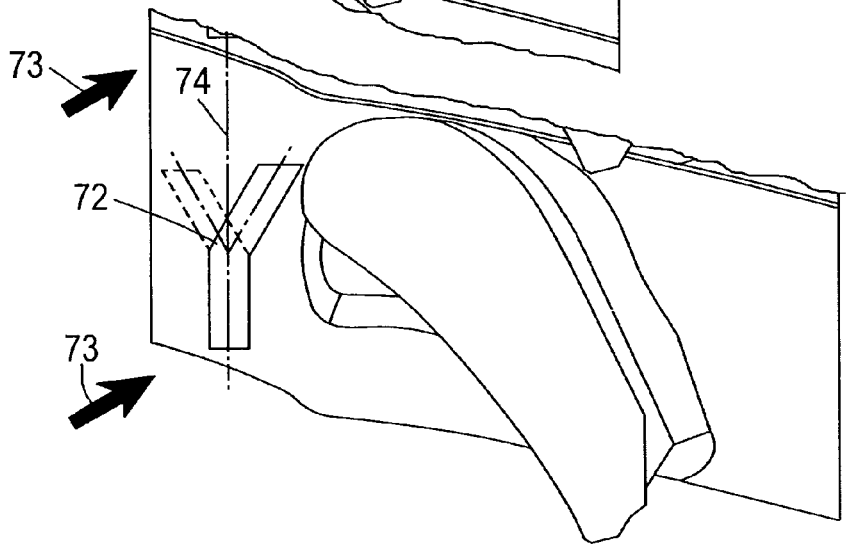
Figure 8:
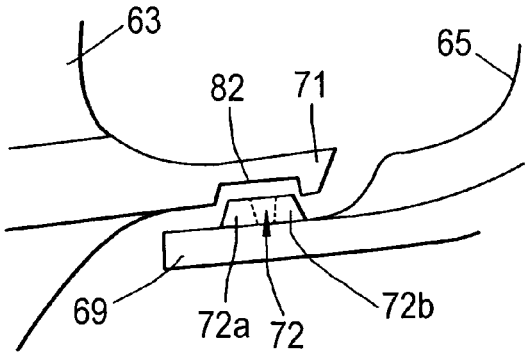
Figure 9:
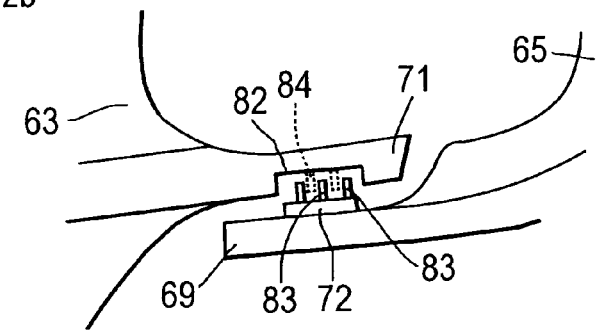

FIG. 6*b* is a part section A-A in FIG. 6*a* in accordance with the present invention;

FIGS. 7*a* and 7*b* are plan views of alternative embodiments of the present invention;

FIGS. 8 and 9 are part sections A-A in FIG. 6*a* in accordance with alternative embodiments of the present invention.

In accordance to aspects of the present invention, and in order to achieve a more even distribution of coolant flow over a blade platform hot gas wipe surface, a deflector element is provided which acts as a partial blockage feature in a gap through which a coolant flow is presented to a blade platform. As indicated above the coolant flow will pass through the gap at a front upstream edge of the platform to the aerofoil. In such circumstances, the deflector element as indicated acts as a partial block to resist flow across the front of the blade to account for differential actions such as hot gas partial vortices stimulating coolant flow to one side of the blade leading edge in comparison with the other. It will be understood that the position and in particular with regard to a rotating element the relative position of the deflector element is critical to ensuring that the coolant flow is directed towards the base of the blade leading edge. Such position will disrupt the passage of hot gas entrained due to horse shoe vortices etc upon the coolant flow. It will be understood that the particular position of the deflector element will depend upon operational requirements which typically is a function of the aerofoil leading edge inlet angle, this is to say the angle at which coolant flow is presented and the location of the aerofoil leading edge upon the platform surface.

Generally, the deflector element presents a blocking feature which will be cast within a forward section of a blade platform. The forward section will be upstream of the hot gas wash surface. In such circumstances the deflector element will direct the coolant flow toward the aerofoil leading edge in such a manner that a major proportion of the coolant flow passes onto the pressure surface of the platform. Such disproportionate presentation of the coolant flow will enhance cooling and protection of appropriate parts of the platform subjected to hot gas streaming. Such proportioning will also provide remedial action with regard to detrimental effects of horse shoe vortices and peel off around the pressure surface in the vicinity of the aerofoil/platform.

Typically the coolant flow will pass over the platform pressure surface then migrate under the influence of the pressure role and secondary flow onto the downstream suction surface of the neighbouring platform in an assembly. In such circumstances, there will be less need for dedicated cooling of this neighbouring suction surface blade platform allowing more efficient utilisation of cooling flows available.

Figure 3:
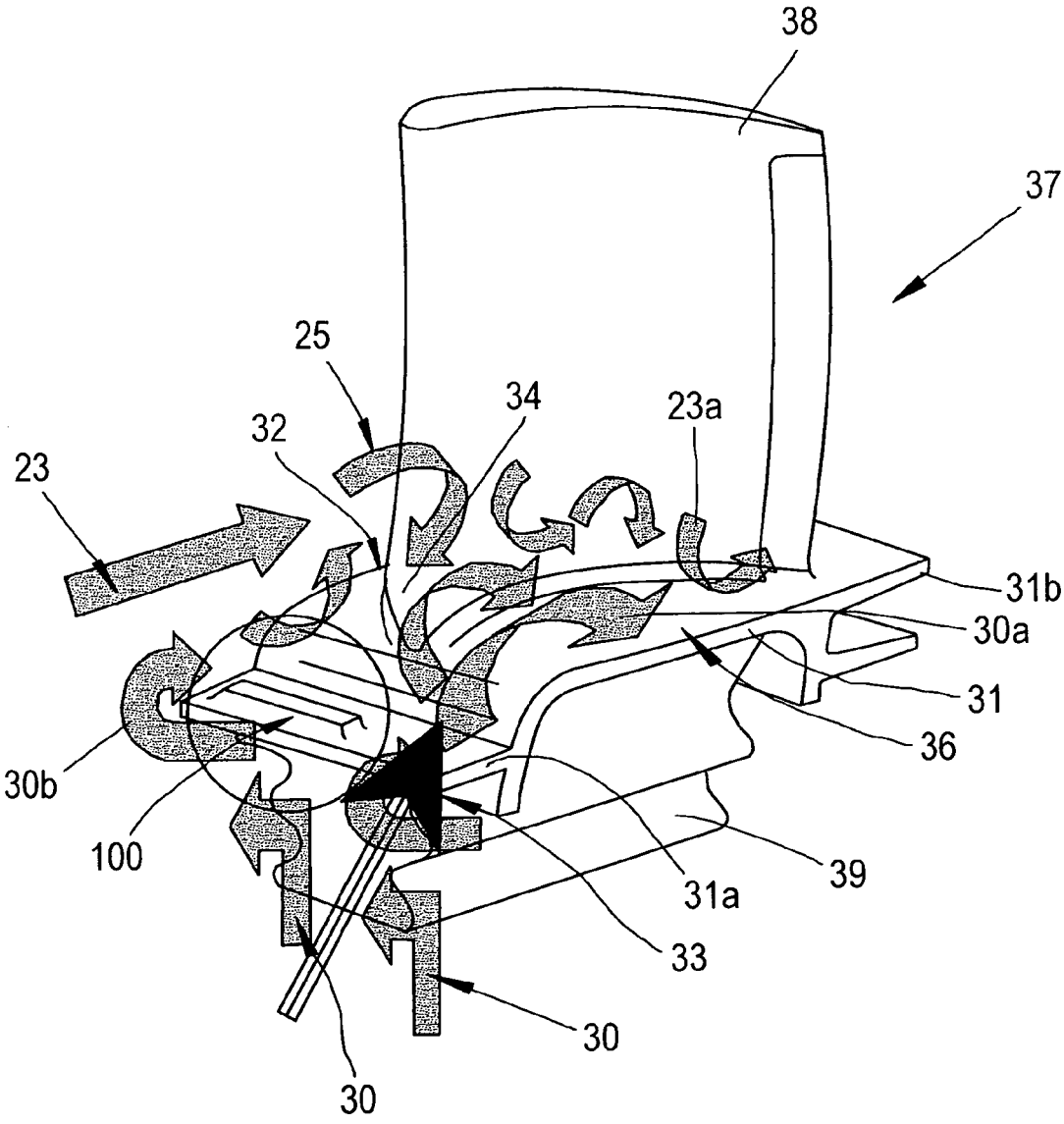
FIG. 3 is an isometric schematic illustration of a first embodiment of aspects to the present invention.

FIG. 3 provides an isometric schematic view of a high pressure turbine blade in accordance with a first embodiment of aspects of the present invention. Thus, as previously a blade 38 is presented upon a platform 31 with a pressure surface 36 and a suction surface 32 either side of a leading edge 34. The platform 31 has an extension 31*a* extending forwards and a coolant flow 30 arranged to pass in use over the platform 31 and extension 31*a* to cool a root portion of the blade 38. As previously a hot gas flow 23 creates hot gas vortices 25 which tend to create disproportional coolant deflections with respect to the surfaces 32, 36.

In accordance to aspects of the present invention a deflector element 100 is presented upon the platform extension 31*a*. In the first embodiment depicted in FIG. 3 the deflector element 100 is presented and placed towards the suction side 32 of the platform 31. In such circumstances the coolant flow 30 is directed between the deflector elements 100 in adjacent blades 38 in a blade assembly. Thus, coolant flows towards the aerofoil blade 38 and in particular the leading edge 34 and preferentially towards the pressure surface 36. In such circumstances the deflector element 100 achieves an appropriate proportioning of the coolant flow 30 in an arrangement 37 such that an enhanced film cooling protection is provided adjacent the pressure surface 38 and in particular with regard to the hot gas flow 23.

Figure 1:
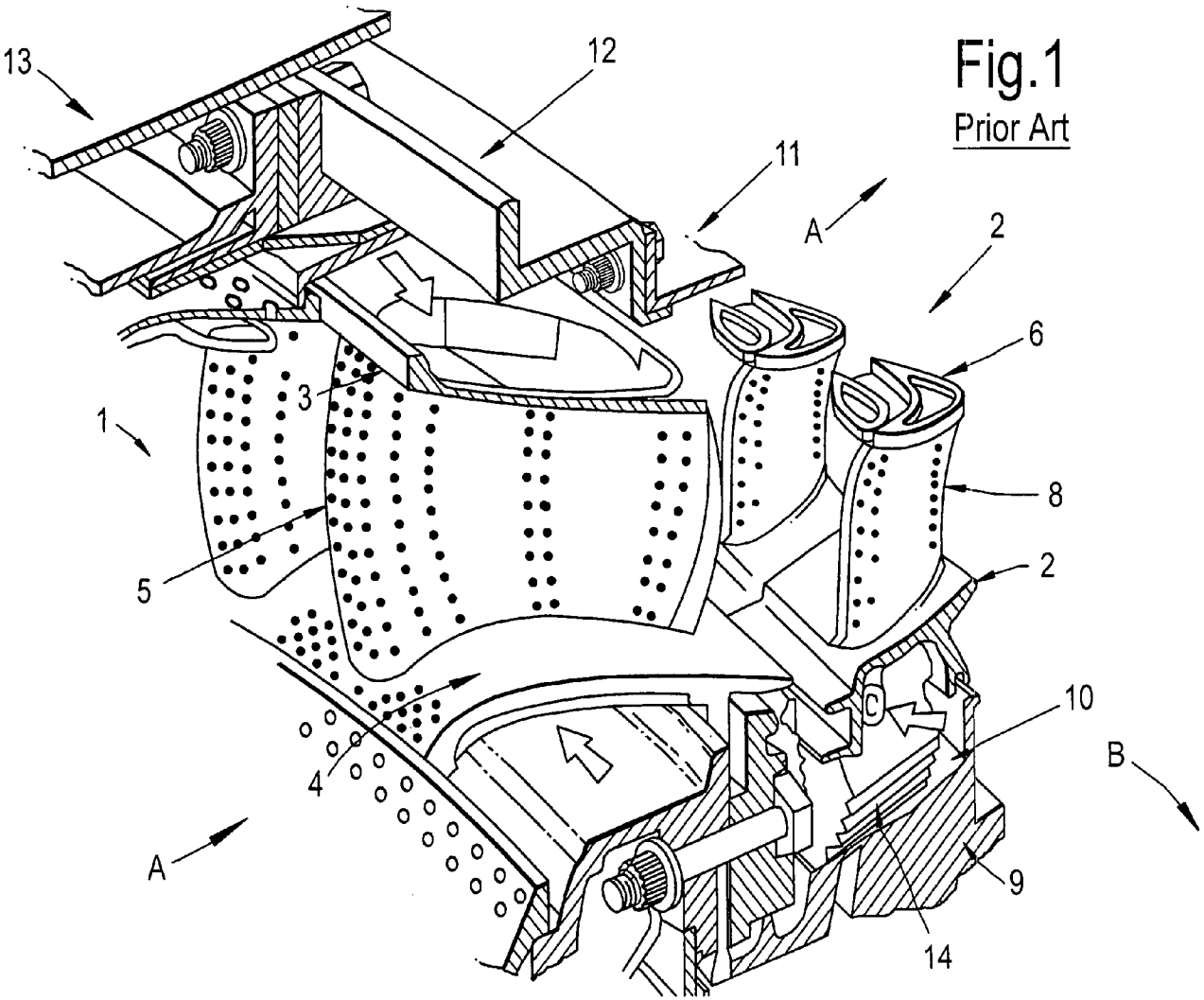
Fig.1 Prior Art
FIG. 1 is an illustration of a typical prior art rotor assembly including a nozzle guide vane (NGV) and a rotor blade array.
Figure 2:
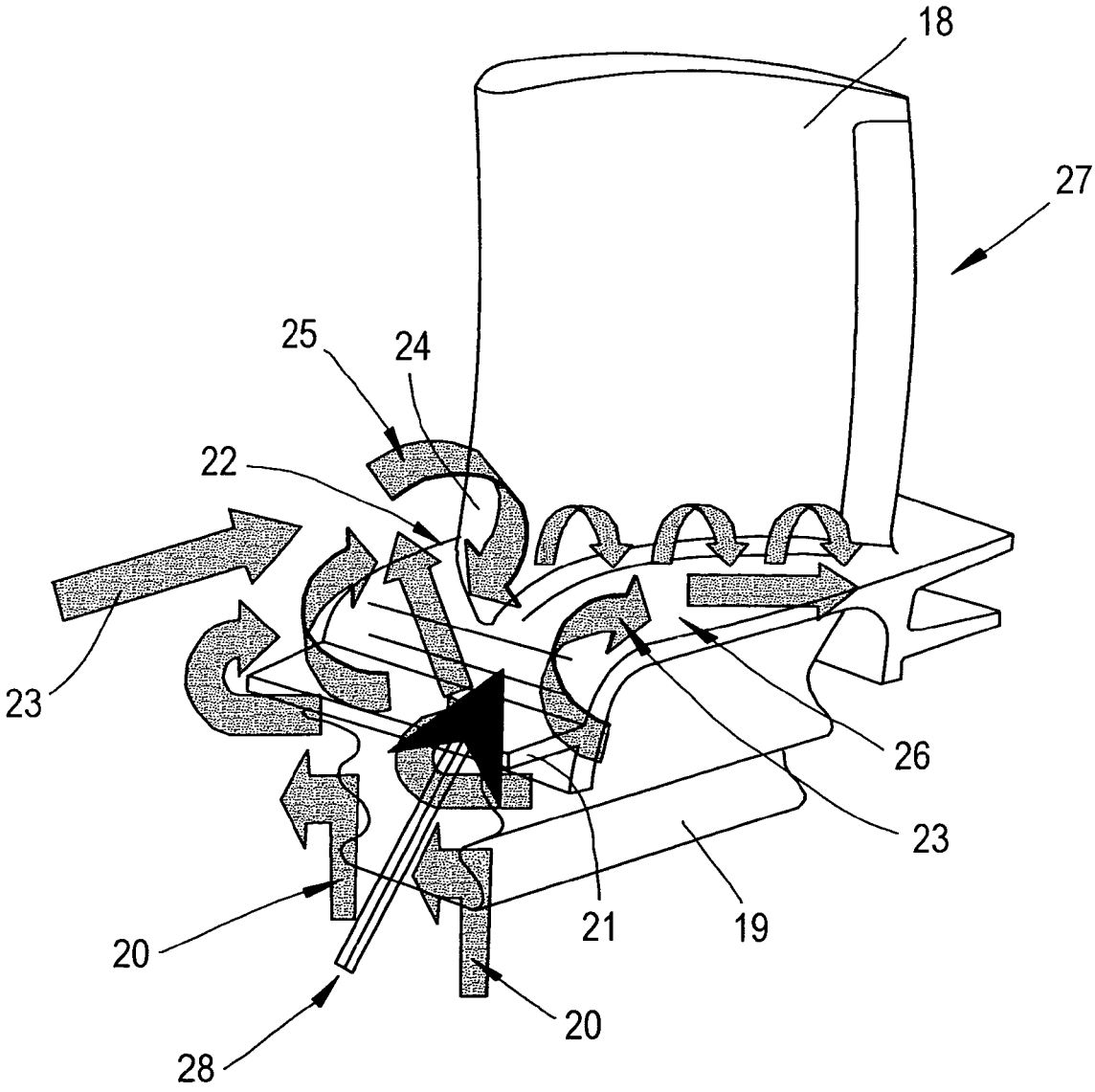
Fig.2 Prior Art
FIG. 2 is an isometric schematic view of a prior art high pressure turbine rotor assembly.

As can be seen the platform 31 is secured through a root 39 which, as described previously, is secured to a rotor disk. The coolant flow 30 is a leakage flow passing upwards from a cavity below the platform with an inlet angle 33 defined by a manner of presentation of the coolant flow 30 to the blade 38 about the platforms 32, 36 either side of the leading edge 34. It will be noted that by provision of the deflector element 100 a resistance to flow is presented by the deflector 100 and therefore partial blockage. None the less some coolant flow 30*b* will pass either over or to the side of the deflector element 100 to cool the suction side 32 but proportionality coolant flow 30*a* will be greater in order to cool the pressure surface 36. In use as described above with regard to FIG. 1 it will be noted that blades 38 are presented generally circumferentially upon a rotor disk. In such circumstances the pressure surface 36 on one blade arrangement 37 is adjacent a suction surface 32 on an adjacent blade arrangement 37. In such circumstances a spent or mixed coolant flow 30*a* with hot flow 23*a* will be presented to the suction surface 32 of an adjacent arrangement 37 downstream and therefore provide some cooling effect. As described above typically greater cooling effect may be required upon the pressure surface 36 in comparison with the suction surface 32 and in such circumstance portioning of coolant flow for effectiveness may be acceptable.

Figure 4:
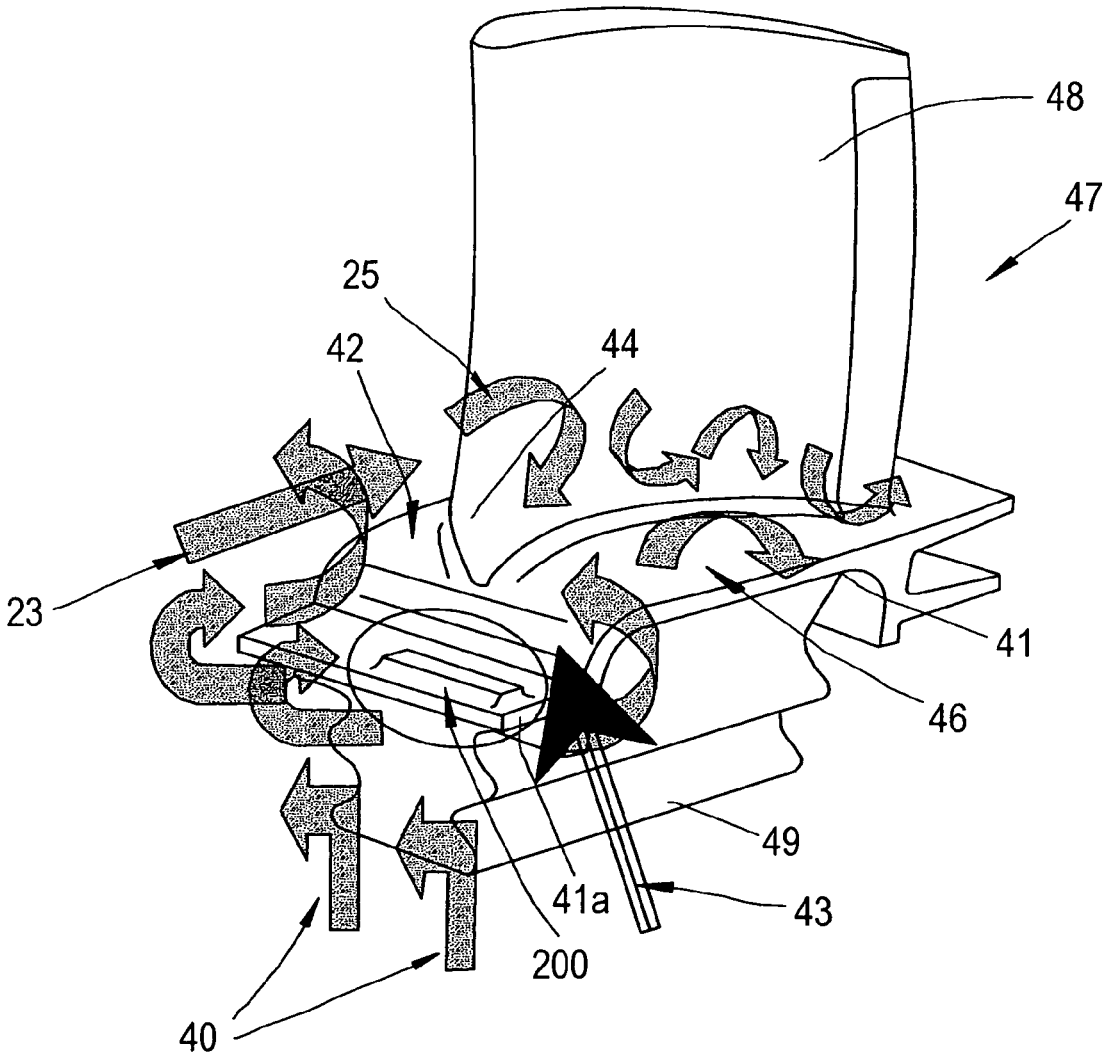
FIG. 4 is an isometric schematic illustration of a second embodiment of aspects of the present invention.

FIG. 4 provides an isometric schematic illustration of a second embodiment of aspects of the present invention. As previously a blade 48 is attached upon a platform 41 with a suction side 42 and a pressure side 46. The platform 41 has a forward extension 41*a*. The blade 48 is secured through a root 49 which defines a cavity through which coolant leakage flow 40 is purged over the front extension 41*a* to present coolant flow in an arrangement 47. As described previously a hot gas flow 23 is presented. The flow 23 due to the nature of the blade 48 will create horse shoe vortices 25.

As above the coolant flow 40 by positioning and orientation of a deflector element 200 allows more appropriate utilisation of the coolant flow 40 for better effect with regard to an arrangement 47. In the second embodiment depicted in FIG. 4 the deflector element 200 again blocks flow 40 but is repositioned circumferentially towards the pressure side 46 compared to deflector element 100 (FIG. 3). The arrangement 47 will accommodate for change in inlet angle 43 of gas at the blade 48 and in particular root section 49. Nevertheless, as previously generally the flow 40 will still be arranged towards a leading edge 44 such that flow 40 is proportioned either side of the edge 44 between the surfaces 42, 46. Furthermore, coolant flow is proportioned to provide appropriate film protection to the pressure side 46 in response to the hot gas horse shoe vortices generated by the configuration and shape of the blade 48.

It will be understood that the actual positioning of the deflector element 200 as a deflector as well as a blocking feature for the flow 40 can be dependent upon overall blade arrangement as well as blade assembly configuration within a gas turbine engine as appropriate. As will be described later the configuration, shape and orientation of the respective deflector element may be chosen and vary dependant upon requirements.

Figure 5:
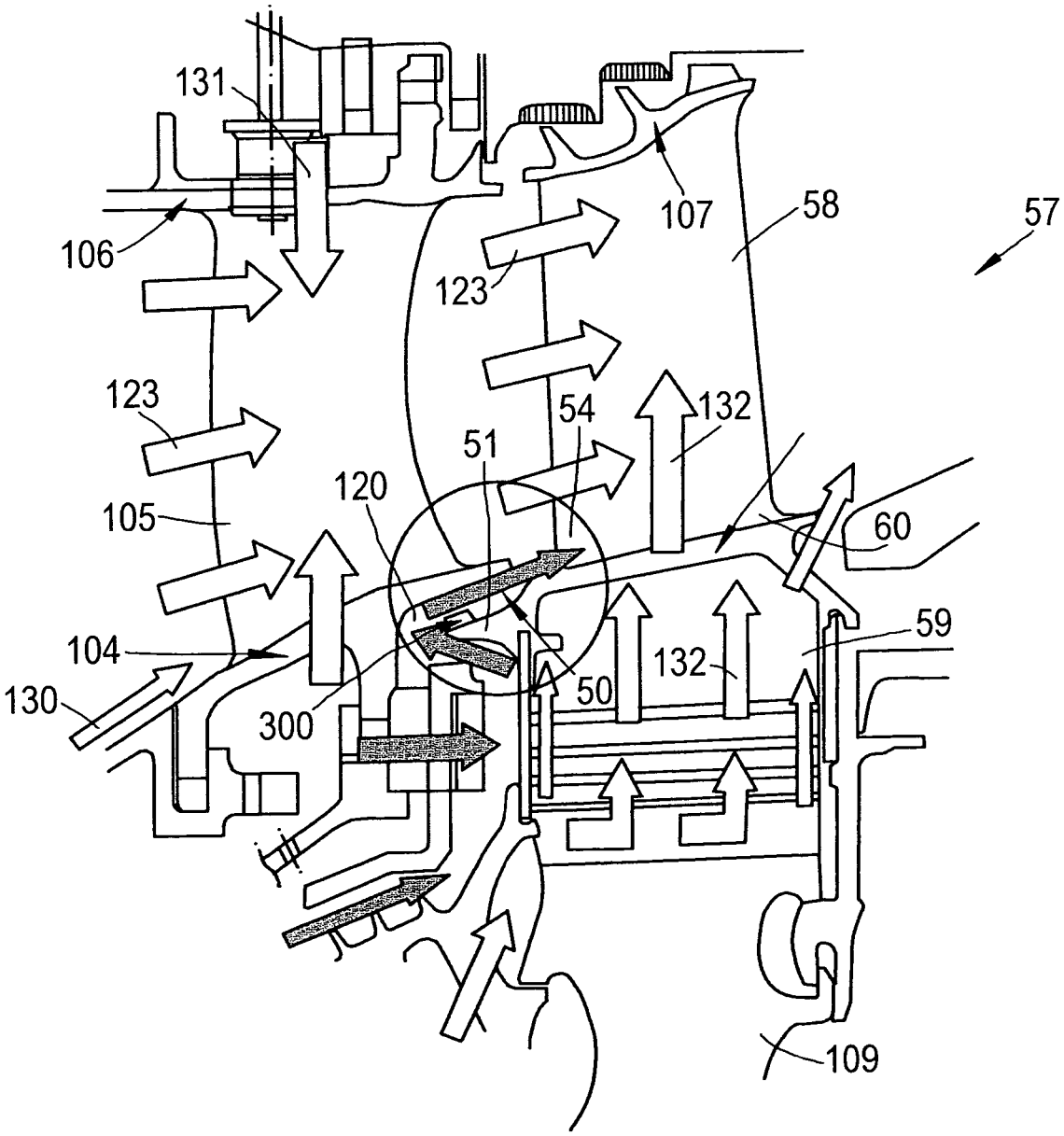
FIG. 5 is a schematic side view of a guide arrangement in accordance to aspects of the present invention; and, FIG. 6*a* is a plan view on two turbine blades in accordance with the present invention.

FIG. 5 provides a side cross sectional view of a blade arrangement 57 in accordance with aspects of the present invention. A rotor blade 58 is secured through a root element 59 to a rotor disk and each blade 58 in the blade assembly will have a blade platform 56. Cooling of the platform 56 and in particular towards a root section of the blade 58 is of particular concern with regard to aspects of the present invention. A leading edge 54 receives a coolant flow 50 which originates within a blade assembly and is passed in the direction of the arrowheads for appropriate presentation to the platform 56.

It will be noted that a nozzle guide vane 105 is provided and that hot gas flow 123 passes over the aerofoil of the nozzle guide vane 105 to the blade 58 between an inner platform 104 and an outer platform 106 about the vane 105 and between the platform 56 and a shroud 107 about the blade 58. The hot gas flow 123 as indicated above generally will create horse shoe vortices which direct hot gas flow down towards the platform 56 typically on the pressure side 60 as described previously.

In accordance with aspects to the present invention as described above a deflector element 300 is positioned upon a forward extension 51 of the platform 56 in order to appropriately proportion the coolant flow 50 either side of the leading edge 54. The coolant flow 50 is generated as the coolant flow is purge from a cavity 120 and is presented at an appropriate inlet angle as described above. It will be noted that the deflector element 300 extends across a gap defined on one side by the platform extension 51 and upon the other side by a proportion of the inner platform 104 of the nozzle guide vane 105. By extending across the gap created within the cavity 120 it will be appreciated the position of the deflector element 300 effectively reduces and partially blocks the coolant flow 50 precipitating the proportioning of that flow 50 either side of the leading edge 54. The relative positioning of the nozzle guide vane 105 and in particular the inner platform 104 to create a rear overhang opposing the forward extension 54 of the platform 56 allows the presentation of the coolant flow 50 in accordance to aspects of the present invention. It will be appreciated that the gap between the rear portion of the inner platform 104 and the forward projection 51 of the platform 56 will vary dependant upon operational stage. At the start the arrangement 57 will be cold and in some circumstances the gap created in the cavity 120 will therefore be different to that at typical normal operating temperatures. In such circumstances the configuration of the components and in particular presentation of the rear portion of the inner platform 104 relative to the forward platform projection 51 will be considered in order to achieve appropriate presentation of the coolant 50 typically at an operational state rather than at an initial cool state. It will be understood during engine operation the platform 56 and the forward platform projection 51 will generally move apart axially and together radially. In such circumstances the spacing of the gap will increase such that the deflector 300 will constitute a smaller proportion of the variable width in the cavity 120 when the arrangement is hot in comparison with initial cooler stages but nevertheless there will be an overlapping association between parts of the inner platform 104 and the forward platform extension 51 adequate to achieve presentation of the coolant flow 50.

It will be understood that generally the shape of radial positioning in platform 104 may require modification in a number of situations in order to accommodate the deflector element 300. Such modification and consideration will be necessary in order to ensure that the deflector element 300 will not rub with the platform 104 and that contact is avoided during engine operation.

It will be understood that other coolant flows 130, 131 will generally also be provided within the arrangement 57 in order to cool the vane 105 and the blade 58 through internal convection cooling and film cooling upon the blade surfaces. Aspects to the present invention are particularly related to cooling around a root portion 60 of the blade 58 and therefore achieve appropriate presentation of the coolant flow 50. As indicated above the proportion of coolant flow overall taken by the coolant flow 50 will be 1-2% but nevertheless due to more effective use of current flow 50 there will be more efficient operation.

FIGS. 6*a* and 6*b* are a plan view on two turbine blades and a part section respectively and are in accordance with the present invention. As before, a rotor assembly 61, having a rotational axis 62 comprises a first component 63 and a rotor 64 arranged about the axis 62. The rotor 64 comprises an annular array of radially extending blades 65 each having a pressure surface 66, a suction surface 67, a blade root 68 and a platform 69 that extends forwardly from the blade root and overlaps the platform 70 of the first component 63 to define the gap 71 therebetween. The platforms 69 of adjacent blades 64 abut one another. The platform 69 comprises a deflector 72 extending from the platform towards the first component across the gap such that at least a portion of a fluid 73 passing through the gap 72 is deflected towards the pressure surface 66. As can be seen in FIG. 6*a*, a leakage or cooling flow 73, as described hereinbefore e.g. flow 50 in FIG. 5, flows between the front part of platform 69 and the rear part of platform 70 of the upstream or first component 63.

It should be appreciated that as the coolant flow exits from the gap 71 it mixes with the main working fluid passing through the engine. The coolant flow typically can be around 0.5-2% of the main gas flow and therefore the combined gas flow, near to the radially inner part of the blade and platform, is likely to be in the general direction of the main gas flow. However, it should be noted that the main working gas flow is both turbulent and unsteady and hence the angle of the main working flow can vary significantly even at a specific engine operating point. Thus the angle of the coolant flow, when mixed with the main working gas, is given as an average angle of the combined mass flow.

The deflector 72 is generally elongate with respect to an axis 74, in this case generally perpendicular to the rotational axis 62. The deflector has a first end 75 and a second end 76 and the second end is circumferentially rearward, with respect to the direction of rotation (arrow 77), of the first end.

At cruise engine conditions this coolant flow 73 has an angle $\alpha$ of incidence with the blades and in particular with a leading edge 78 thereof. To direct the coolant flow 73 onto the pressure surface the deflector 72 is positioned on the platform where its first end is positioned to intersect a line 79 at an angle $\theta=\alpha$ from a line 80 parallel to the rotational axis 62; each line meeting at the leading edge 78. In one known example the angle $\theta=40°$, but for other engine applications the angle $\theta$ may be between 20° and 60°.

To function most effectively the deflector extends a distance 81, in a circumferential direction, between 25% and 75% of the circumferential length L of the platform of each blade. One preferable length 81 of the deflector is 50% of the circumferential length of the platform of each blade.

The deflector is straight and extends generally in a circumferential direction; however, as shown in FIG. 7*a*, the deflector 72' or 72" may be arcuate with respect to the circumferential direction. Furthermore, at least a part of the deflector can be angled with respect to the circumferential direction as shown in FIG. 7*b*.

Referring now to FIGS. 8 and 9, which show alternative embodiments of the present invention. To assist in deflecting the coolant flow away from suction surface of the blade and coolant leaking over the top of the deflector, the first component defines a trough 82 adjacent the deflector and in which the deflector 72 runs. This means that the coolant flow 73 passing over the top of the deflector is required to take a more tortuous flow path, causing turbulence and a higher static pressure thereby forcing more flow around the deflector and onto the pressure surface. Further loss producing features can be used to increase resistance to the coolant flow leaking over the top of the deflector, and one such arrangement is the deflector comprising at least one rib 83 that extends radially outwardly. Alternatively, the deflector may comprise two or more deflectors 72*a* 72*b* shown in FIG. 8. Within the trough 82 the platform may comprise at least one radially inwardly extending rib 84 which may either be alone or inter-digitise with the deflector's rib(s) 83. The rib(s) may be angled forwardly or rearwardly with respect to a radial line. It should be appreciated that the deflector may comprise many other sealing configurations as are well known to the those skilled in the art of seals and particularly, but not exclusively, seals that seal between relatively rotating components whether in a gas turbine engine or not.

By aspect of the present invention there is provided a reduction in the harmful effects of leading edge horse shoe hot gas vortices which may cause localised platform overheating. Furthermore, more specific and useful film cooling protection to the platform pressure surface is given particularly to the forward regions of that platform. There is generally a reduction in the quantity of dense cool leakage air passing around a suction surface of the platform and up the suction side of the aerofoil. By aspects of the present invention platform thermal gradients are reduced and potential problems with regard to thermal fatigue, cracking and oxidation limiting component life are diminished. There is generally a reduction in aerofoil to platform flow mixing losses and generally there is a potential for reduction in the quantity of dedicated coolant flow required to cool the blade platform. It will be understood that by reducing the proportion of dedicated cooling and aerofoil suction surface leakage mixing losses a general improvement in overall stage efficiency for the turbine and therefore a lower specific fuel consumption for the engine achieved. By improving the efficiency of the overlap between the forward platform extension and the rear portions of the inner platform of the nozzle guide vane it will be understood that there is a potential to provide a reduction in the quantity of leakage required to purge the cavity acting as a well for the coolant flow in accordance with aspects of the present invention.

As indicated above generally the deflector arrangement in accordance with aspects of the present invention acts to block and guide coolant flow. In such circumstances the particular shape of the deflector element can be adjusted dependant upon operational requirements and configurational requirements. A deflector element can be cast with the forward extension of the platform or the extension provided as a specific separate component secured appropriately. Such separate component may be secured through welding or by provision of a rebated slot within which a root portion of the deflector element can be secured.

The deflector elements may have different circumferential lengths and thicknesses and widths in order to achieve the desired presentation and proportional distribution of the coolant flow either side of the leading edge of a blade.

In the above circumstances typically a blade platform may incorporate one or more deflector elements in accordance with aspects of the present invention. In particular deflector elements may be segmented either fully in order to create upstanding distinct teeth segments or with slots to an appropriate depth in each segment in order to create a castellated or finger configured deflector element.

Generally, deflector elements will be configured to only extend partially across the width of a blade platform forward extension. However, deflector elements could be provided which extend fully across the width of a platform forward extension. However, in such circumstances generally the height that is to say the height across the gap towards a rear portion of the nozzle guide vane will be variable in order to achieve the control and proportioning of coolant flow either side of the leading edge of the blade.

In order to improve coolant leakage control it will be appreciated that deflector elements may extend towards a groove formed in a lower surface of the inner nozzle guide vane platform. In such circumstances a labyrinth or indirect route for the coolant flow is provided creating further control and improving sealing performance. Improved sealing performance as described above will generally increase the efficiency of utilisation of coolant in accordance with aspects of the present invention.

Generally, the deflector elements in accordance with aspects of the present invention will be presented substantially perpendicularly to a leading edge of a blade. However alternatively, the deflector elements may be orientated at an angle other than perpendicular in order to deflect the coolant leakage flow towards a desired location upon the platform.

A deflector element in accordance with aspects of the present invention may typically be substantially straight and extend as indicated above laterally relative to the blade leading edge. Alternatively, a deflector element may be curved either concavely or convexly relative to the leading edge in order to achieve the desired proportioning of coolant flow either side of the leading edge.

It will be understood that a deflector element in accordance with aspects of the present invention typically must be presented in an upstanding configuration such that the deflector element cannot be provided extending downwardly from the inner platform of the nozzle guide vane. If there were such downward presentation the leakage flow would not be directed exclusively onto the base of the aerofoil and therefore onto the blade platform pressure surface achieving the desired improvements in cooling efficiency in accordance with aspects of the present invention.

As indicated above generally arrangement and assembly in accordance with aspects of the present invention will be such that the deflector element does not rub or come into contact with an opposed surface in the gap in accordance with aspects of the present invention. Thus, variation in the width is utilised in order to achieve partial blockage and so regulation of coolant flow to the blade platform for film cooling effect. It will be understood that as indicated above a deflector element may be cast into the platform leading edge extension or be combined as a separate component with an appropriate fixing mechanism. If a separate component is utilised it may be more convenient to provide variations in the extension of the deflector element and other configurations for the deflector element at different positions circumferentially in a blade assembly. In such circumstances different cooling effectiveness can be achieved at different positions if required. Such variations may also create a potential for variations as the rotor disc assembly rotates stimulating coolant flow by an impeller effect. It will also be understood that by providing separate components to define the deflector elements in accordance with aspects of the present invention and particularly if those elements are secured through an appropriate mechanism easier replacement of the deflector elements may be achieved.

Generally, a top surface of the deflector element will be straight and flat in order to provide consistency in opposition to an opposite side of the gap in accordance with aspects of the present invention. Alternatively, as described above the deflector element may vary in height and therefore projection across the gap circumferentially. Further alternatively, the deflector element may incorporate a ramp or wedge configuration to an upper surface varying in projection across the gap from a front side to a rear side in order to again provide some variation with regard to presentation of the coolant flow in accordance with aspects of the present invention.

Modifications and alterations will be appreciated by those skilled in the technology thus for example rather than providing flat topped deflector elements in accordance with aspects of the present invention alternatives may include a more finely pointed edge to the deflector element or a rounded surface to the deflector. Such shaping may be reciprocated in a bottom surface of the opposed surface defining the gap such as the inner platform of a nozzle guide vane. It will also be understood that the opposed surface may incorporate grooves or fins in order to provide further entrainment guiding and presentation of the coolant to the blade platform.

Each blade is described herein as having its own platform and root; however, it is possible for a blade assembly to comprise two or more aerofoils on one single unitary platform, which may have a common or multiple roots for securing to a disc. Thus the terms "a blade root" and "a platform" should be taken to also mean common blade root and common platform. Each aerofoil having its own effect portion of such a common platform.

I claim:

1. A gas turbine engine comprising a rotor assembly having a rotational axis, the assembly comprising a first component and a rotor arranged about the axis, the rotor comprising an annular array of radially extending blades each having a pressure surface, a suction surface, a blade root and a platform that extends forwardly from the blade root and overlaps the first component to define a gap therebetween, the assembly is characterised in that the platform comprises a deflector extending from the platform towards the first component across the gap such that at least a portion of a fluid passing through the gap is deflected towards the pressure surface.

2. A gas turbine engine as claimed in claim 1 wherein the deflector is elongate with a first end and a second end, the second end is circumferentially rearward, with respect to the direction of rotation, of the first end.

3. A gas turbine engine as claimed in claim 2 wherein blade comprises a leading edge; the deflector is positioned on the platform wherein its first end is positioned at an angle $\theta$ between 20° and 60° from a line parallel to the rotational axis and that meets the leading edge.

4. A gas turbine engine as claimed in claim 2 wherein blade comprises a leading edge; the deflector is positioned on the platform wherein its first end is positioned at an angle $\theta=40°$ from a line parallel to the rotational axis and that meets the leading edge.

5. A gas turbine engine as claimed in claim 2 wherein a working gas impinges on the rotating blade at an angle $\alpha$ relative to the axis; the blade comprises a leading edge and the deflector is positioned on the platform wherein its first end is positioned to intersect a line at an angle $\theta=\alpha$ from a line parallel to the rotational axis each line meeting at the leading edge.

6. A gas turbine engine as claimed in claim 1 wherein the deflector extends in a circumferential direction between 25% and 75% of the circumferential length of the platform of each blade.

7. A gas turbine engine as claimed in claim 1 wherein the deflector extends in a circumferential direction 50% of the circumferential length of the platform of each blade.

8. A gas turbine engine as claimed in claim 1 wherein the deflector is straight and extends generally in a circumferential direction.

9. A gas turbine engine as claimed in claim 1 wherein the deflector is arcuate with respect to the circumferential direction.

10. A gas turbine engine as claimed in claim 1 wherein at least a part of the deflector is angled with respect to the circumferential direction.

11. A gas turbine engine as claimed in claim 1 wherein the first component defines a trough adjacent the deflector.

12. A gas turbine engine as claimed in claim 1 wherein the deflector is segmented.

13. A gas turbine engine as claimed in claim 1 wherein the deflector and/or trough comprises at least one rib that extends radially outwardly.

14. A gas turbine engine as claimed in claim 1 wherein at least one rib is angled from a radial line.

15. A gas turbine engine as claimed in claim 1 wherein the first component is rotating.

* * * * *